US005410843A

United States Patent [19]

Gottschald

[11] Patent Number: 5,410,843

[45] Date of Patent: May 2, 1995

[54] PROCESS FOR FINISHING THE EDGE OF CORRECTIVE LENSES MADE OF PLASTIC

[75] Inventor: Lutz Gottschald, Meerbusch, Germany

[73] Assignee: Wernicke X Co. GmbH, Düsseldorf, Germany

[21] Appl. No.: 701,675

[22] Filed: May 16, 1991

[51] Int. Cl.[6] ..... B24B 9/14

[52] U.S. Cl. ..... 450/43; 451/58; 451/450

[58] Field of Search ..... 51/284 R, 326, 327, 51/283 E, 284 E, 267, 322

[56] References Cited

U.S. PATENT DOCUMENTS

| | | | |
|---|---|---|---|
| 2,674,068 | 4/1954 | Eves et al. | 51/284 E |
| 3,520,091 | 7/1970 | Raphael | 51/284 E |
| 4,322,915 | 4/1982 | Kindig | 51/283 E |
| 4,908,996 | 3/1990 | Friedman et al. | 51/284 E |

*Primary Examiner*—Robert A. Rose

[57] ABSTRACT

An improved process for finishing the edge of corrective lenses made of thermoplastic material or of a mixture of thermoplastic and thermosetting plastic materials. This process includes the steps of dry pre-profiling and dry post-profiling the corrective lens and the further subsequent additional process step of wet final finishing and/or calibrating the corrective lens by using an additional fine grinding wheel and applying cooling liquid to the contact area between said corrective lens and said fine grinding wheel.

5 Claims, 1 Drawing Sheet

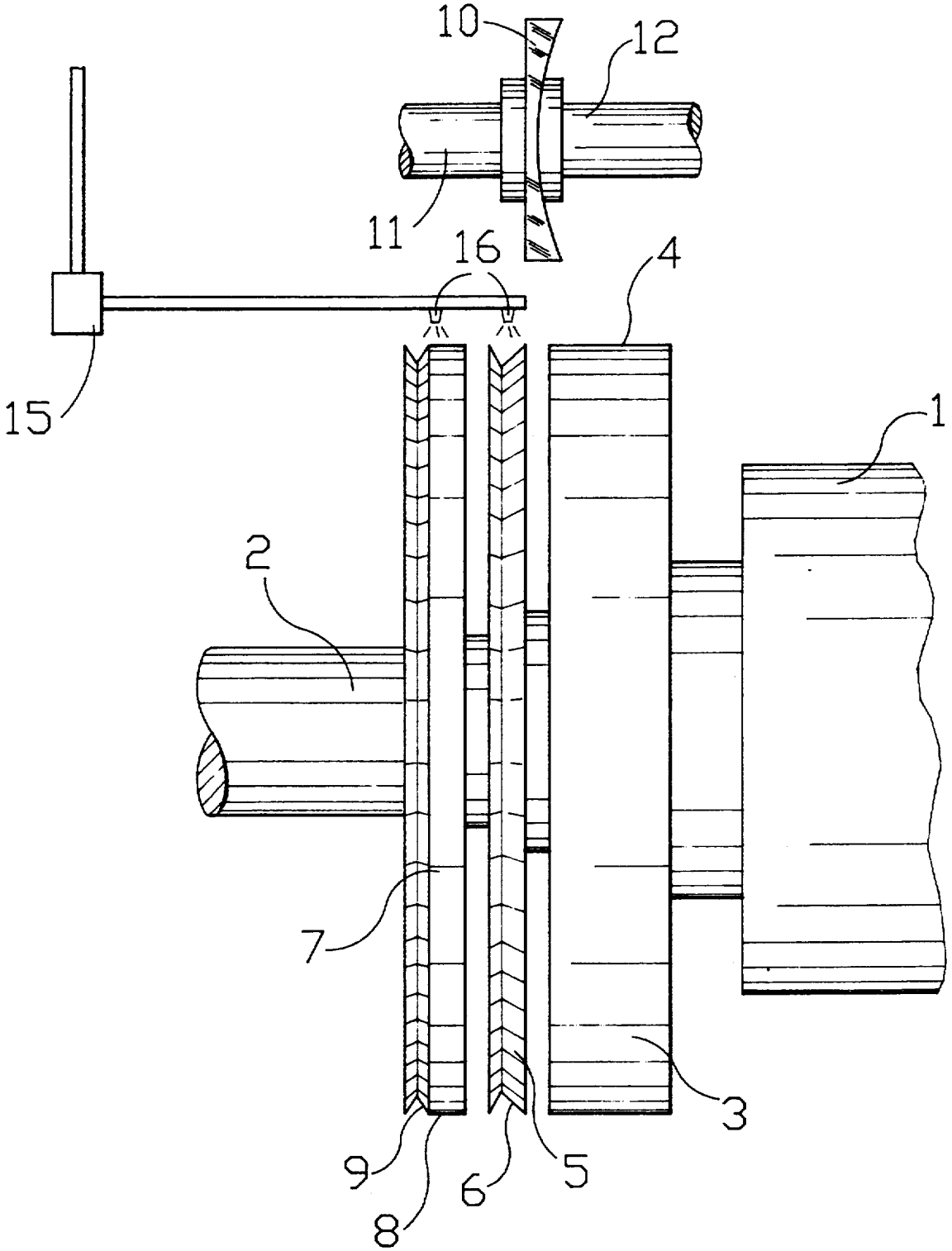
10
12
11
16
4
15
1
2
7
3
9
8
6
5

PROCESS FOR FINISHING THE EDGE OF CORRECTIVE LENSES MADE OF PLASTIC

BACKGROUND OF THE INVENTION

The invention relates to a process for finishing the edge of corrective lenses made of plastic and in particular of corrective lenses made of thermoplastic or of a mixture of a thermoplastic and a thermosetting plastic.

A corrective lens edge grinding machine suitable for such a process is described in German utility patent specification, patent number 86 23 058. This patent discloses a set of grinding wheels which differ from one another, for the preliminary and finishing steps of grinding corrective lenses on a carrier frame which is mounted slidingly in two horizontal coordinate axes on the base frame and which carries the grinding wheel with a drive motor.

As a rule, a corrective lens will be pre-profiled while still wet with the assistance of a template, by means of a roughing wheel, whereby the greatest part of the glass to be removed is removed during this phase. This is followed by wet post-profiling including, if appropriate, simultaneous grinding of the peripheral bevel, and calibrating at a further cylindrical wheel exhibiting a grain of appropriate fineness.

In this prior known process for finishing corrective lens edges, it is difficult to achieve sufficient surface quality at the edges of the corrective lens during post-profiling and calibrating. Particularly in the case of rimless spectacles, a great emphasis is placed on achieving a smooth, finely finished glass edge. Furthermore, when finishing the edges of ophthalmic lenses made of plastic, and in particular, those made of thermoplastic materials, there is a danger that this material will be heated during the grinding step, and that the abraded material will load up on the fine-grained surface of the post-grinding wheels, causing them to clog.

SUMMARY OF THE INVENTION

The present invention is aimed at solving the above noted problems by improving the quality in finishing the edges of corrective lenses consisting of, wholly or partially, of a thermoplastic material, whereby the lenses are rendered relatively light in weight, so that a finely finished surface at the edges of the corrective lenses will be achieved with a simple apparatus and without interfering with the workings of the apparatus and procedure.

Operating on the basis of the above identified problems, it is proposed, in accordance with the present invention, that following a process of the type mentioned at the outset, and subsequent to dry pre-profiling and to dry post-profiling, a further, short step be added, incorporating additional wet line finishing and/or calibrating using a fine grained grinding wheel.

It has surprisingly been found that simply applying a liquid to the area in which the corrective lens and the grinding wheel, for final finishing and calibrating,come in contact, brings about a considerable improvement in surface quality at the edges of the corrective lenses even when in this third step the usual post-profiling grinding wheel is advantageously used to make a further pass around the edges of the corrective lens.

It is additionally also possible to provide an additional and separate fine finishing grinding wheel for a third step, i.e., a pre-profiling grinding wheel, a post-profiling grinding wheel and a final finishing and calibrating grinding wheel.

To achieve the finest possible finish at the surface of the lens edge, it is sufficient to execute one revolution of the corrective lens while applying a cooling liquid so that, in particular, when finishing a corrective lens without using an additional, and separate fine finishing grinding wheel, only a negligible extension of the grinding time for a corrective lens is required. This additional processing time can be shortened by carrying out the fine finishing at an elevated grinding wheel rotation speed, as compared with the speed for the pre-profiling and the post-profiling.

A preferred embodiment of the pre-profiling grinding wheel has a grain of ≧D 180, and the post-profiling and fine finishing grinding wheel have a grain of ≦D 46. With the selection of the proper rotation speed, these preferred grain sizes are not susceptible to clogging during the dry pre-profiling and the dry post profiling phases, and nontheless, produces, during the final finishing with the application of a cooling liquid, a very good, score-free surface quality.

BRIEF DESCRIPTION OF THE DRAWINGS

The invention is described in further detail below using a preferred embodiment as schematically illustrated in FIG. 1.

DESCRIPTION OF THE PREFERRED EMBODIMENT

A drive motor 1 exhibits a shaft 2 upon which is mounted a pre-profiling grinding wheel 3 exhibiting a cylindrical surface area 4, a bevel grinding wheel 5 exhibiting twin conical surfaces 6, and a further finish grinding wheel 7 exhibiting a cylindrical surface area 8, and narrow, twin conical surface areas 9 for a narrow bevel. Finish grinding wheel 5 serves to apply a beveled edge to corrective lenses which are relatively thin at the edge, whereas finish grinding wheel 7 serves to apply a beveled edge to corrective lenses which are relatively thick at the edge, or to grind, for example, a smooth surface for rimless spectacles.

A corrective lens 10 is held between two shaft halves 11, 12, and is initially given a contour approximating the final shape of the lens, this being done at pre-profiling wheel 3 with the help of a template. After repositioning the edge of the glass to grinding wheel 5, or grinding wheel 7, the lens is pre-profiled and subsequently post-profiled.

The blank is initially moved against the pre-profiling grinding wheel 3 exhibiting a coarse grain preferably ≧D 180 and is shaped in a dry grinding step to the desired shape with a small amount of supplementary material to enable carrying out post-profiling at the finish grinding wheel 5 or 7. These wheel 5 or 7 exhibit a fine grain of ≦D 46.

Following these two dry grinding steps, the corrective lens 10 is kept in contact with a post-profiling grinding wheel 5 or 7 for one further revolution, while at the same time, a cooling liquid is applied by means of a pump 15 through nozzles 16 which spray said cooling liquid into the area of the contact point between the corrective lens 10 and the finish grinding wheel 5 or 7. By way of illustration, the two nozzles 15, 16 are shown above the wheels 5, 8; in actual practice they will be located at an angle above the axis of the corrective lens 10.

This additional fine finishing and post-profiling step with the application of a cooling liquid, results in a surface having a high quality at the finished edge of the corrective lens 10.

As explained supra, the grain of the final grinding wheel 5 or 7 is preferably ≦D 46. This grain does not clog during dry post-profiling, but is fine enough to achieve a considerably improved surface quality during the final finishing step with the application of a cooling liquid.

A milling device may be substituted for pre-profiling grinding wheel 3. It is further possible, in addition to the grinding wheels for dry post-profiling, to install on shaft 2, further grinding wheels for final finishing with the application of a cooling liquid.

The speed of the drive motor 1 can be adjusted to suit the properties of the corrective lenses being worked, whereby the rotation speed when processing plastic lenses must be selected so that there will be no excessive heating of the plastic lenses during the pre-profiling, and the dry post-profiling steps and to avoid clogging the grinding wheel. The speed of the drive motor can be increased for final finishing with the application of a cooling liquid whereby the surface quality is improved and the final finishing step can be shortened.

A further measure which can be taken to avoid the clogging of the grinding wheels during pre-profiling and post-profiling consists of utilizing as the material for plastic corrective lenses a combination of a thermoplastic such as polycarbonate, for example, and a thermoset plastic.

I claim:

1. Process for finishing the edges of a corrective lens made of thermoplastic material or of a mixture of thermoplastic and thermosetting plastic materials, including a dry first profiling step using a relatively rough grinding wheel and a dry second profiling step using a relatively fine grinding wheel and a wet third step applying cooling liquid to the contact area between said corrective lens and said fine grinding wheel.

2. The process as set forth in claim 1, wherein said relatively rough grinding wheel is mounted on a shaft and said relatively fine grinding wheel is mounted on the said same shaft separate from said relatively rough grinding wheel.

3. The process as set forth in claim 1, wherein said wet third step by said fine grinding wheel is effected in one revolution of said corrective lens.

4. The process as set forth in claim 1, wherein said wet third step is carried out at an elevated grinding wheel speed relative to the grinding wheel speed of said dry first profiling step and said dry second profiling step.

5. The process as set forth in claim 1, wherein said relatively rough grinding wheel has a grain of ≧D 180 and said fine grinding wheel has a grain of ≦D 46.

* * * * *

UNITED STATES PATENT AND TRADEMARK OFFICE

CERTIFICATE OF CORRECTION

PATENT NO. : 5,410,843
DATED : May 2, 1995
INVENTOR(S) : Lutz Gottschald

It is certified that error appears in the above-identified patent and that said Letters Patent is hereby corrected as shown below:

On the title page, item [73] Assignee, should read -- Wernicke & Co.

GMGH Jagerstrabe, Dusseldorf, Germany --.

Column 2,
On the title page, before item [57] insert attorney, agent and firm of Klein & Vibber Signed and Sealed this Twelfth Day of September, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,410,843
DATED : May 2, 1995
INVENTOR(S) : Lutz Gottschald

It is certified that error appears in the above-identified patent and that said Letters Patent is hereby corrected as shown below:

On the title page, item [73] Assignee, should read -- Wernicke & Co. GmbH, Jägerstraße, Düsseldorf, GERMANY --.

Column 2,
On the title page, before item [57] insert attorney, agent and firm of Klein & Vibber This certificate supersedes Certificate of Correction issued September 12, 1995.

Signed and Sealed this
Ninth Day of September, 1997

Bruce Lehman

*Attest:*

BRUCE LEHMAN

*Attesting Officer*

*Commissioner of Patents and Trademarks*

US005410843B1

REEXAMINATION CERTIFICATE (3540th)

United States Patent [19]

Gottschald

[11] B1 5,410,843

[45] Certificate Issued Jun. 9, 1998

[54] PROCESS FOR FINISHING THE EDGE OF CORRECTIVE LENSES MADE OF PLASTIC

[75] Inventor: Lutz Gottschald, Meerbusch, Germany

[73] Assignee: Wernicke & Co., Dusseldorf, Germany

Reexamination Request:
No. 90/004,645, Apr. 18, 1997

Reexamination Certificate for:

| | |
|---|---|
| Patent No.: | **5,410,843** |
| Issued: | **May 2, 1995** |
| Appl. No.: | **701,675** |
| Filed: | **May 16, 1991** |

Certificate of Correction issued Sep. 12, 1995.

Certificate of Correction issued Sep. 9, 1997.

[51] Int. Cl.[6] ..... B24B 9/14

[52] U.S. Cl. ..... 451/43; 451/58; 451/450

[58] Field of Search ..... 451/43, 57, 58, 451/44, 42, 450, 53

[56] References Cited

U.S. PATENT DOCUMENTS 4,841,676 6/1989 Barwasser ..... 451/461

FOREIGN PATENT DOCUMENTS 2-284866 11/1990 Japan .

OTHER PUBLICATIONS

Gankyo Shimbum, Advertisement for IOFT Trade Show, May 25, 1990.

*Primary Examiner*—Robert A. Rose

[57] ABSTRACT

An improved process for finishing the edge of corrective lenses made of thermoplastic materials or of a mixture of thermoplastic and thermosetting plastic materials. This process includes the steps of dry pre-profiling and dry post-profiling the corrective lens and the further subsequent additional process step of wet final finishing and/or calibrating the corrective lens by using an additional fine grinding wheel and applying cooling liquid to the contact area between said corrective lens and said fine grinding wheel.

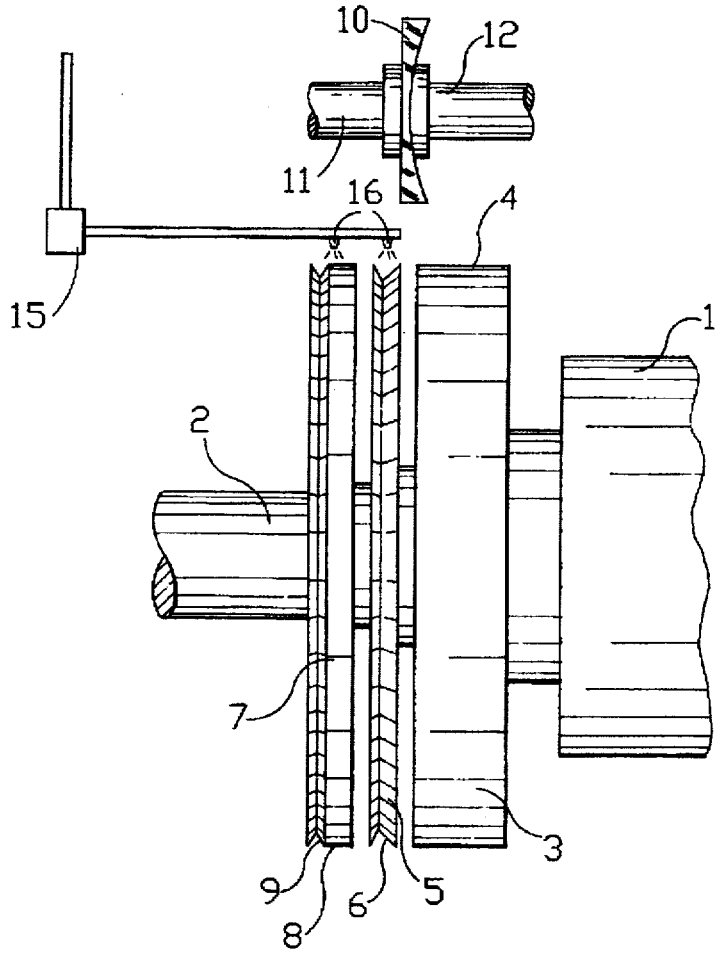

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *